US006801234B2

(12) United States Patent
Nishimura

(10) Patent No.: US 6,801,234 B2
(45) Date of Patent: Oct. 5, 2004

(54) COLOR THERMAL PRINTER

(75) Inventor: Tomoyoshi Nishimura, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/701,454

(22) Filed: Nov. 6, 2003

(65) Prior Publication Data

US 2004/0090517 A1 May 13, 2004

(30) Foreign Application Priority Data

Nov. 6, 2002 (JP) ..... 2002-323108

(51) Int. Cl.[7] ..... B41J 35/16
(52) U.S. Cl. ..... 347/175
(58) Field of Search ..... 347/175, 171–172, 347/179, 183, 188–189; 400/120.02, 120.03, 120.07, 120.09

(56) References Cited

U.S. PATENT DOCUMENTS 6,088,050 A * 7/2000 Ng ..... 347/237
6,108,019 A 8/2000 Katsuma et al.
6,283,570 B1 * 9/2001 Komiya et al. ..... 347/15
6,384,895 B1 * 5/2002 Sawano ..... 355/40

FOREIGN PATENT DOCUMENTS

JP 2002-029078 A 1/2002

* cited by examiner

*Primary Examiner*—K. Feggins
(74) *Attorney, Agent, or Firm*—Sughrue Mion, PLLC

(57) ABSTRACT

A color thermal printer is provided with a humidity sensor and a paper type discerning sensor. The humidity measured in the humidity sensor is converted to a humidity dependency correction coefficient by an LUT memory. The paper type discerned by the paper type discerning sensor is converted to a paper type dependency correction coefficient by an LUT memory. Image data of one line is converted to a coefficient of dynamic friction of each heating element. A printing load calculator calculates the printing load of one line based on the coefficient of dynamic friction of one line, the humidity correction coefficient, the paper type correction coefficient, and pressing force of a thermal head. The rotation speed of a feeding motor for feeding a color thermal recording paper is controlled in response to the printing load of each line.

9 Claims, 6 Drawing Sheets

COLOR THERMAL PRINTER

BACKGROUND OF THE INVENTION

1. Field of the Invention

The present invention relates to a color thermal printer, and more particularly to a color thermal printer in which a color registration error can be prevented even at the time of variation of a printing load.

2. Description of the Prior Arts

As a color thermal printer, there has been known a color thermal printer in which a full color image is printed on a color thermal recording paper in a three-color frame sequential fashion. The color thermal recording paper includes yellow, magenta, and cyan thermosensitive coloring layers overlaid on a support in sequence. The color thermal recording paper is fed by feeder roller pairs constituted of a capstan roller and a pinch roller. While feeding the recording paper, each heating element of a thermal head is caused to generate heat based on image data, and thereafter one of three primary color images is printed line by line.

The value integrated a coefficient of dynamic friction between a thermal head and a surface of the recording paper to pressing force of the thermal head acts as the printing load. Heat energy of the color thermal recording paper is different by each primary color to be recorded. If the heat energy to be applied to the color thermal recording paper is increased, a protective layer which covers outside of the yellow thermosensitive coloring layer is softened, so that the coefficient of dynamic friction is lowered. If the coefficient of dynamic friction is lowered, feeding speed of the color thermal recording paper becomes fast because the printing load is also lowered. Since the feeding speed of the recording paper is changed by the color to be recorded, the color registration error, density unevenness, and so forth are created.

Therefore, there has been known a color thermal printer in which the paper feeding speed of the color thermal recording paper is kept constant by controlling of the rotation speed of a feeding motor in response to the printing load calculated based on the image data, for example, as disclosed in Japanese Patent Laid-Open Publication No. 2002-029078. In addition, it is known to adjust one line print cycle based on the printing load calculated based on the image data, for example, as disclosed in U.S. Pat. No. 6,108,019 (corresponding to Japanese Patent Laid-Open Publication No. H11-058806).

However, the coefficient of dynamic friction in the color thermal recording paper is changed by humidity, contamination of the thermal head, and type of the color thermal recording paper. Therefore, the color registration error and the density unevenness cannot be prevented effectively only by consideration of the printing load based on the image data.

SUMMARY OF THE INVENTION

An object of the present invention is to provide a color thermal printer for printing an image in consideration of variation of a printing load created by different factors except for image data.

Another object of the present invention is to provide a color thermal printer in which it is possible to prevent color registration error and density unevenness from occurring.

In order to achieve the above and other objects, a color thermal printer of the present invention includes correction means for setting a correction coefficient, a determination device for calculating a printing load of each line, which is corrected by the correction coefficient, and a motor controller for controlling rotation speed of a feeding motor according to the printing load of each line.

The correction means includes at least one of a paper type correction unit, a humidity correction unit, and a sheet number correction unit. The paper type correction unit determines a paper type correction coefficient based on a type of a recording paper. The humidity correction unit determines a humidity correction coefficient based on the humidity. The sheet number correction unit determines a sheet number correction coefficient based on accumulative sheet number. The correction coefficient is determined based on the paper type correction coefficient, the humidity correction coefficient, and the sheet number correction coefficient.

The determination device is operated for calculating the printing load of each line based on image data, pressing force of a thermal head, and the correction coefficient. The motor controller is operated for changing the rotation speed of the feeding motor according to the printing load of each line and feeding the recording paper at regular speed without being affected by the printing load.

According to the preferred embodiment of the present invention, the determination device is constituted of a first converter for converting the image data of one line to the heat energy of each heating element, a second converter for converting the heat energy to each coefficient of dynamic friction, and a printing load calculator for calculating the printing load of one line based on each coefficient of dynamic friction, the correction coefficient, and the pressing force.

According to another preferred embodiment of the present invention, the one-line printing cyclic process is changed in response to the printing load instead of controlling the rotation speed of the feeding motor.

According to the present invention, the printing load, which is obtained on the basis of the image data, is corrected in accordance with different factors, such as the humidity, the sheet number, the paper type, and so forth, so that it is possible to obtain more precise printing load, and to deter the occurrence of the color registration error and the density unevenness in an effective manner.

BRIEF DESCRIPTION OF THE DRAWINGS

The above and other subjects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE PREFERRED EMBODIMENTS

Figure 1:
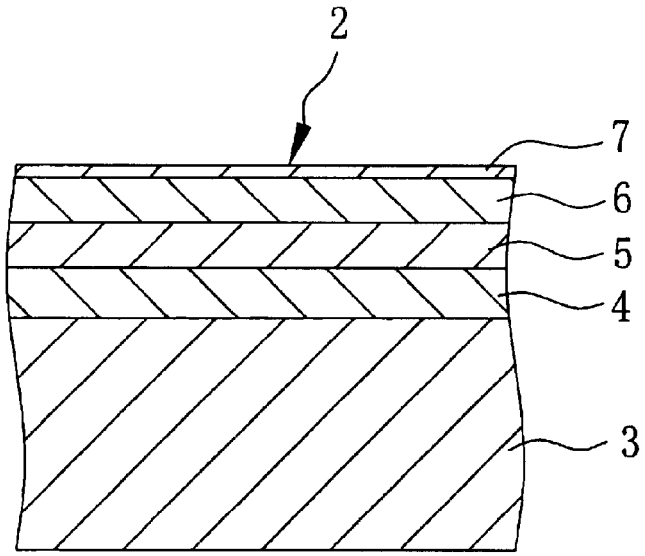
FIG. 1 is an explanatory view shoring a layer structure of a color thermal recording paper.

In FIG. 1, a color thermal recording paper 2 includes a cyan thermosensitive coloring layer 4, a magenta thermosensitive coloring layer 5, and a yellow thermosensitive coloring layer 6 overlaid on a support 3 in sequence. A protective layer 7 is overlaid on the yellow thermosensitive coloring layer 6.

Figure 2:
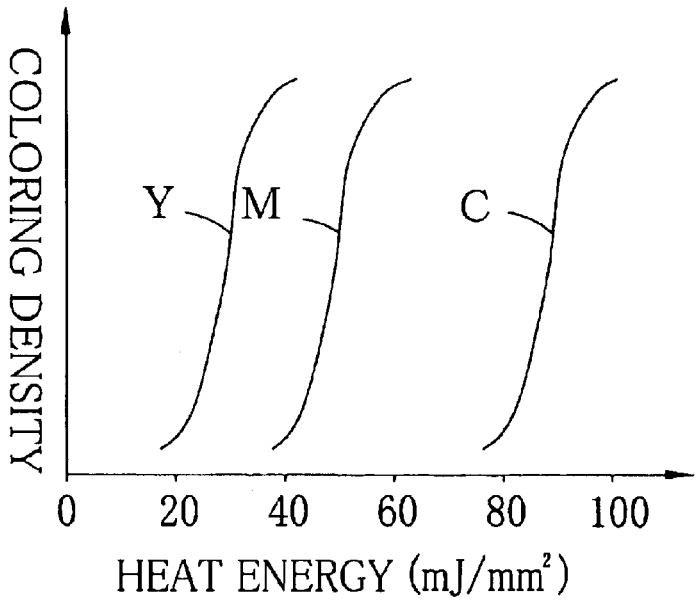
FIG. 2 is a graph showing a coloring property of each thermosensitive coloring layer.

As shown in FIG. 2, the yellow thermosensitive coloring layer 6 is the farthest from the support 3 and has the highest heat sensitivity. The yellow thermosensitive coloring layer 6 develops the yellow color by application of relatively low heat energy. The cyan thermosensitive coloring layer 4 is the closest to the support 3 and has the lowest heat sensitivity. The cyan thermosensitive coloring layer 4 develops the cyan color by application of relatively high heat energy. The yellow thermosensitive coloring layer 6 loses its coloring ability when near-ultraviolet rays of a wavelength peaking at 420 nm are applied thereto. The magenta thermosensitive coloring layer 5 develops the magenta color in heat energy between the necessary energy for coloring the yellow and cyan thermosensitive coloring layers, and loses its coloring ability when ultraviolet rays of a wavelength peaking at 365 nm are applied thereto.

Figure 3:
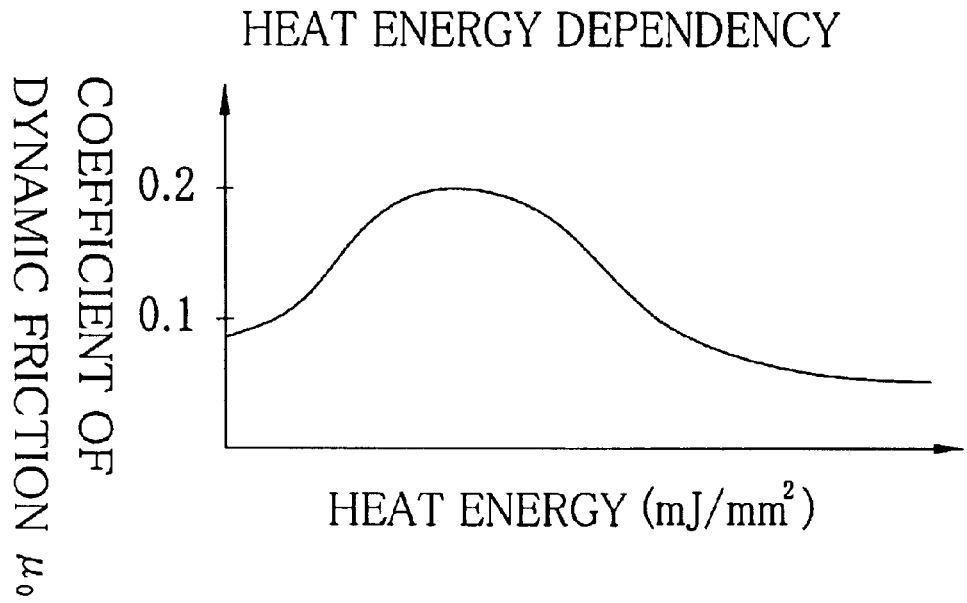
FIG. 3 is a graph showing a heat energy dependency of a coefficient of dynamic friction.

The graph in FIG. 3 shows the dependent property for the heat energy of a reference coefficient of dynamic friction $\mu_0$ between the color thermal recording paper 2 and a thermal head. A normal printing state means the printing in which the humidity is 50%, an unused thermal head free from dust is applied, and a normal type A of the color thermal recording paper 2 is used for example. The protective layer 7 made of resin is softened by application of heat, so that the reference coefficient of dynamic friction $\mu_0$ is changed. The printing load is changed in response to the degree of softening of the protective layer 7. Accordingly, the printing load in printing the yellow image is different from that in printing the cyan image.

Figure 4:
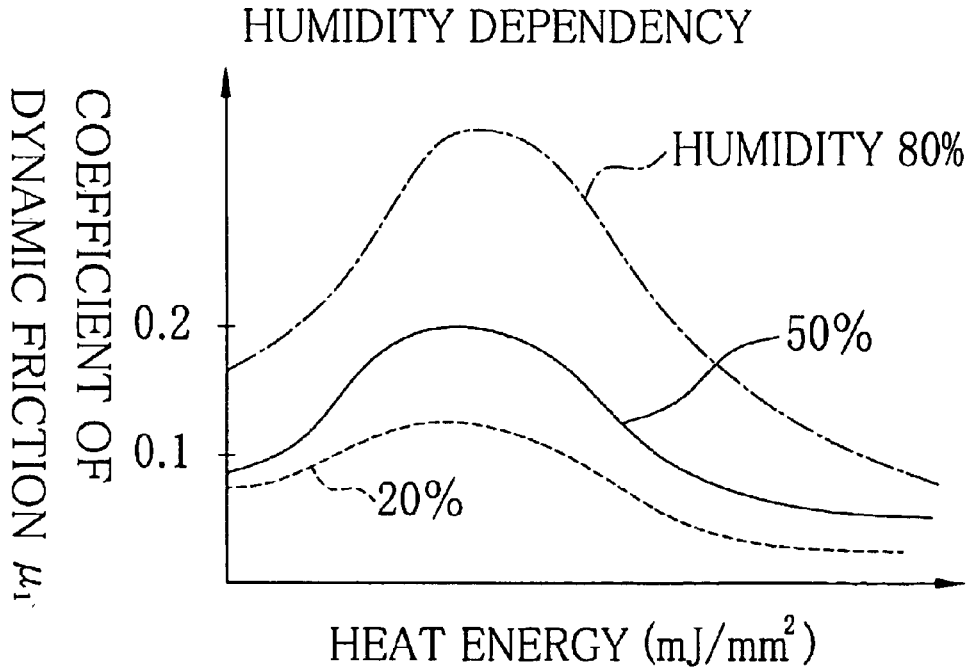
FIG. 4 is a graph showing a humidity dependency of the coefficient of dynamic friction.

The graph in FIG. 4 shows a property of a coefficient of dynamic friction $\mu_1$ between the color thermal recording paper 2 and the thermal head which depends on the humidity. The color thermal recording paper 2 has a property that the coefficient of dynamic friction $\mu_1$ becomes large as the humidity becomes high. The coefficient of dynamic friction at the humidity of 20% is smaller than that at the humidity of 50%. On the other hand, the coefficient of dynamic friction at the humidity of 80% is larger than that at the humidity of 50%. Accordingly, the respective printing loads are different if the printing is performed under different humidity conditions.

Figure 5:
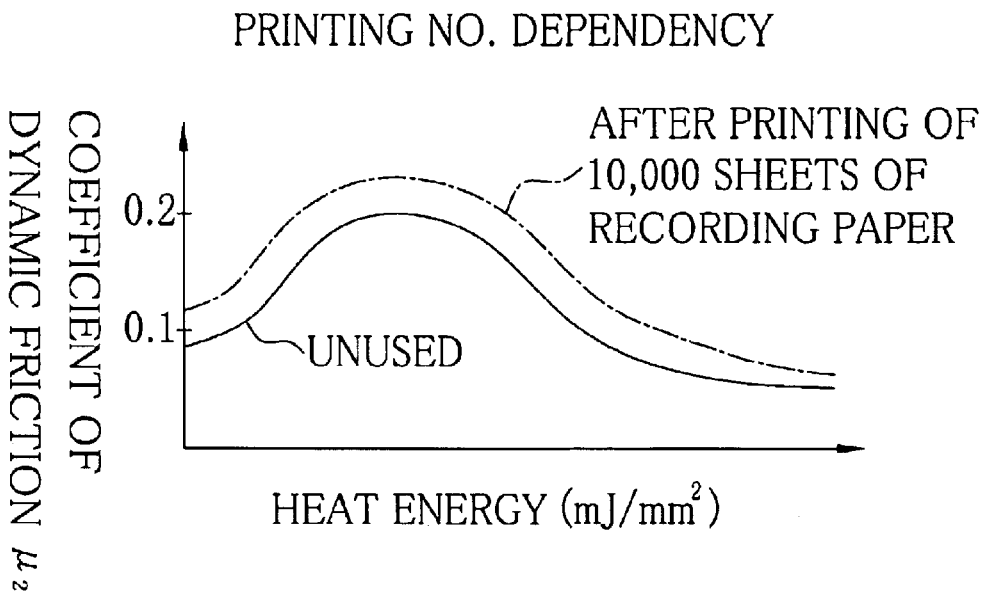
FIG. 5 is a graph showing a sheet number dependency of the coefficient of dynamic friction.

The graph in FIG. 5 shows a property of a coefficient of dynamic friction $\mu_2$ which depends on the accumulative sheet number of sheets printed with the thermal head. There is resin which has been separated or peeled from the protective layer 7 adhered to a surface of a heating element 23*a* (see FIG. 9) of the thermal head. Since the resin is hardened, the surface roughness of the heating element 23*a* is changed. If the sheet number is increased, the surface roughness of the heating element 23*a* becomes large, and therefore the coefficient of dynamic friction $\mu_2$ between the color thermal recording paper 2 and the thermal head also becomes large. Accordingly, the printing load of the unused thermal head is the smallest.

Figure 6:
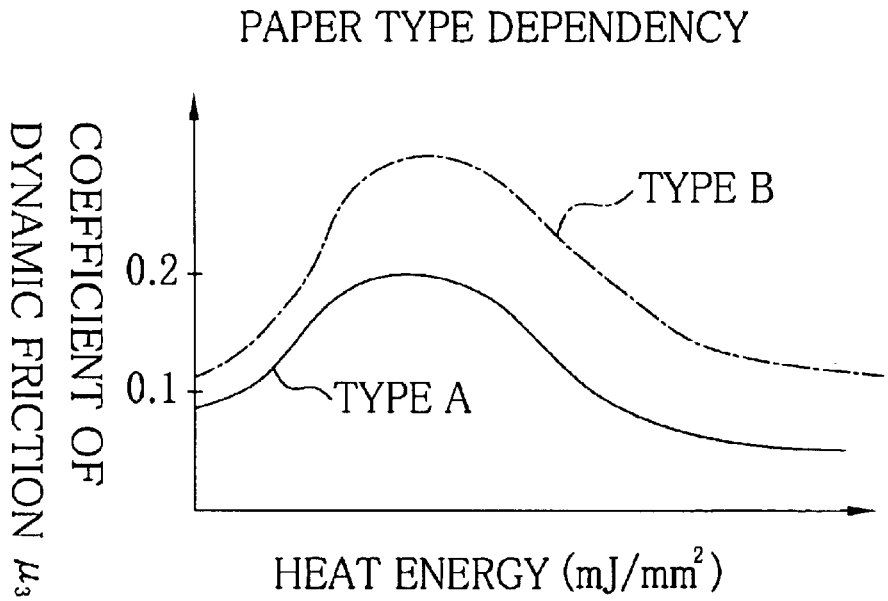
FIG. 6 is a graph showing a paper type dependency of the coefficient of dynamic friction.

The graph in FIG. 6 shows a property of a coefficient of dynamic friction $\mu_3$ which depends on the type of the color thermal recording paper 2. There are some types of the color thermal recording paper having different width dimensions, such as a normal printing paper and a sticker print sheet (seal). For example, the respective coefficients of dynamic friction of the normal paper type A and a paper type B widely vary. The printing load is changed according to the type of the color thermal recording paper.

Figure 7:
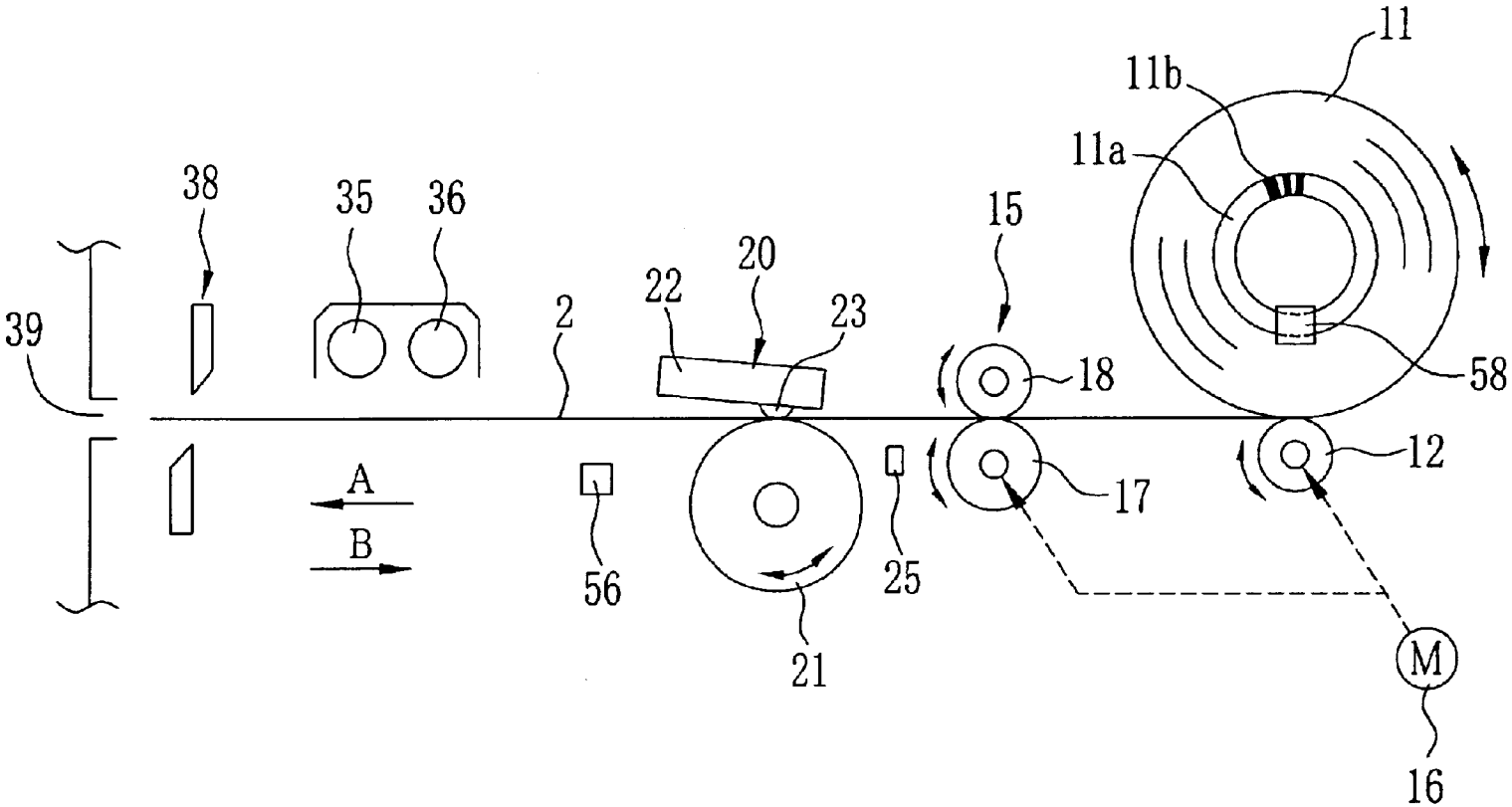
FIG. 7 is an outline view showing a structure of a color thermal printer to which the present invention is applied.

In FIG. 7, the color thermal recording paper is loaded in the color thermal printer as a recording paper roll 11. The recording paper roll 11 is rotated by a supply roller 12, which is in contact with an outer periphery thereof, so that the color thermal recording paper 2 is advanced or withdrawn.

There is a data mark pattern 11*b*, which represents the paper type of the color thermal recording paper 2, sensitivity, and so forth, in an end surface of a roll core 11*a* of the recording paper roll 11. The data mark pattern 11*b* is read by a paper type discerning sensor 58, which is constituted of a reflective photo sensor and other elements.

Feeder roller pairs 15 are disposed on the downstream side in an advancing direction of the recording paper roll 11. The feeder roller pairs 15 are constituted of a capstan roller 17 and a pinch roller 18 pushing against the capstan roller 17. The capstan roller 17 is rotated by a feeding motor 16, such as a stepping motor. The feeder roller pairs 15 are rotated while nipping the color thermal recording paper 2, so that the color thermal recording paper 2 is reciprocally fed in the advancing direction (A direction) and in a withdrawing direction (B direction). A recording paper feeder is constituted of the feeder roller pairs 15 and the feeding motor 16.

Figure 9:
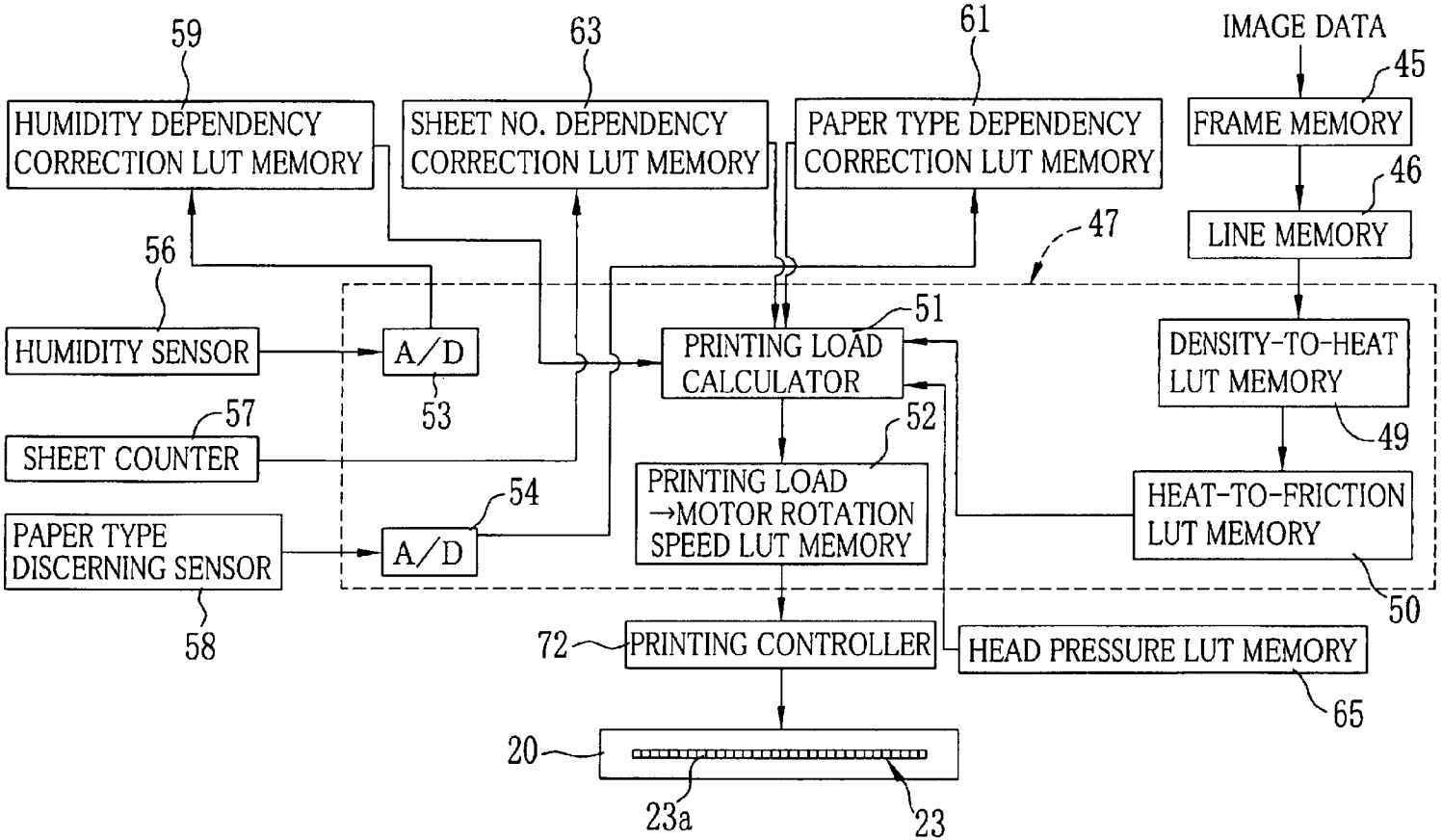
FIG. 9 is a block diagram showing another preferred color thermal printer.

A thermal head 20 as printhead and a platen roller 21 are disposed on the downstream side of the feeder roller pairs 15 so that a feeding path for the color thermal recording paper 2 lies between those. The thermal head 20 has a heating element array 23 formed on a bottom surface of a head substrate 22 made from metal excellent in heat conductivity. The heating element array 23 includes a large number of heating elements 23*a* arranged linearly in a main scanning direction perpendicular to the feeding direction of the color thermal recording paper 2, as shown in FIG. 9. The length of the heating element array 23 is larger than a width dimension of the color thermal recording paper 2, so as to print on the entire recording area of the color thermal recording paper 2 in the width direction.

The platen roller 21 is disposed below the feeding path in opposition to the heating element array 23. The platen roller 21 can be moved in up and down direction, and biased by a spring (not shown) in a direction of pushing against the thermal head 20.

The thermal head 20 develops one color of three thermosensitive coloring layers selectively by means of the heating elements 23*a* based on the image data. The platen roller 21 is rotated in accordance with the feeding of the color thermal recording paper 2 in a state that the color thermal recording paper 2 is pressed against the heating element array 23 by a predetermined pressing force.

A leading edge detecting sensor 25 is disposed between the feeder roller pairs 15 and the platen roller 21. The leading edge detecting sensor 25 detects a leading edge of the color thermal recording paper 2 when the color thermal recording paper 2 is advanced. As the leading edge detecting sensor 25, it is possible to use a reflective photo sensor provided with both a light emitting part for emitting inspection light to the edge of the color thermal recording paper 2 and a light receiving part for receiving the inspection light reflected by the color thermal recording paper 2. A humidity sensor 56 or hygrometer for measuring the humidity in the printer is disposed adjacent to the thermal head 20.

A yellow fixing lamp 35 and a magenta fixing lamp 36 are disposed on the downstream side of the thermal head 20. The yellow fixing lamp 35 emits near-ultraviolet rays of which the wavelength peaks at 420 nm to fix the yellow thermosensitive coloring layer 6. The magenta fixing lamp 36 emits ultraviolet rays of which the wavelength peaks at 365 nm to fix the magenta thermosensitive coloring layer 5.

A cutter device 38 is provided in the downstream side of the yellow fixing lamp 35. The cutter device 38 is operated to cut the long color thermal recording paper 2 every recording area. An exit opening 39 for discharging the color thermal recording paper 2 cut into a sheet is disposed downstream from the cutter device 38.

Figure 8:
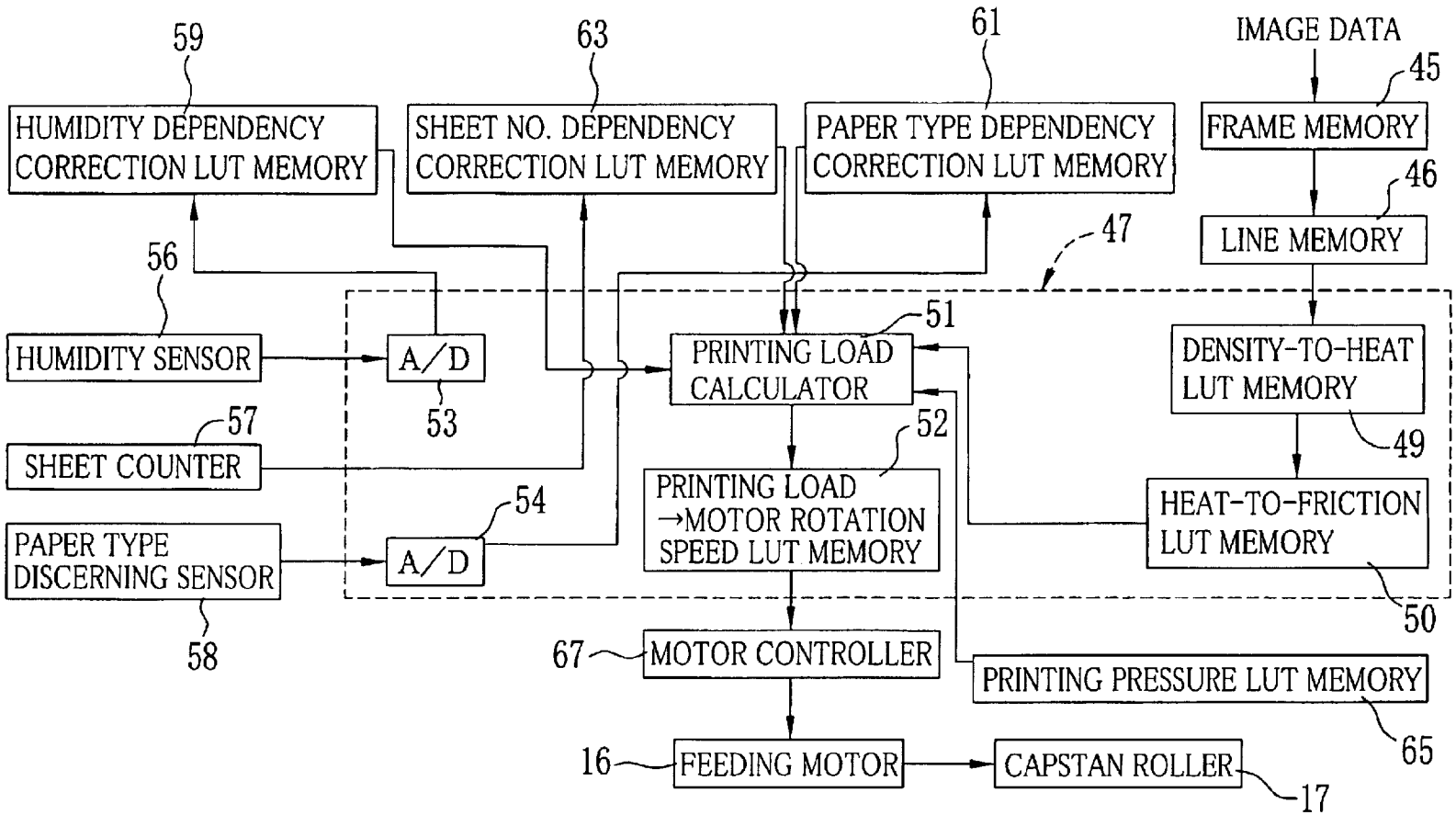
FIG. 8 is a block diagram showing the color thermal printer shown in FIG. 7.

In FIG. 8, image data of three primary colors (R, G, and B) to be printed is input in the color thermal printer from a memory card, a digital camera, a personal computer, and so forth. The frame memory 45 stores one frame of the image data of three primary colors. The one line of the image data of one primary color is read from the frame memory 45, and written as line data in a line memory 46. The line memory 46 is connected with a microcomputer 47.

The microcomputer 47 as a determination device is provided with a density-to-heat LUT memory 49, a heat-to-friction LUT memory 50 and a load-to-speed LUT memory 52, a printing load calculator 51, and two A/D converters 53 and 54. The density-to-heat LUT memory 49 as first converter converts the image data to the heat energy in accordance with the coloring property of the color thermosensitive coloring layer to be recorded. The heat-to-friction LUT memory 50 as second converter stores table data of the heat energy dependent property of the reference coefficient of dynamic friction $\mu_0$ shown in FIG. 3, and converts the heat energy data to the reference coefficient of dynamic friction $\mu_0$. The printing load calculator 51 calculates the printing load line by line with the use of the reference coefficient of dynamic friction $\mu_0$ of each heating element 23*a*, which corresponds to one line of the image data, the pressing force of the thermal head 20 (head pressing force), a humidity dependency correction coefficient, a paper type dependency correction coefficient, and a sheet number dependency correction coefficient. The load-to-speed LUT memory 52 determines the rotation speed of the feeding motor 16 every each line based on the printing load. The feeding motor 16 feeds the color thermal recording paper 2 by one line of the image data by stepping rotations.

The microcomputer 47 is connected with the humidity sensor 56, a sheet counter 57, and the paper type discerning sensor 58. An analog measuring signal is digitalized by the A/D converter 53, and then input in a humidity dependency correction LUT memory 59 (hereinafter referred to as humidity correction). This stores table data of the graph for the humidity dependency shown in FIG. 4. The humidity correction LUT memory 59 determines the humidity correction coefficient a based on the humidity in the printer. The humidity correction coefficient a is input in the printing load calculator 51.

An analog reading signal output from the paper discerning sensor 58 is digitalized by the A/D converter 54, and input in a paper type dependency correction LUT memory 61 (hereinafter referred to as type correction). This stores table data of the graph showing the paper type dependency shown in FIG. 6. A paper type correction coefficient b is determined from the type of the color thermal recording paper 2, and input in the printing load calculator 51.

The sheet counter 57 is counted up every printing, and continues to store the accumulative sheet number from the time that the color thermal printer is started to be used. A count value in the sheet counter 57 is input in a sheet number dependency correction LUT memory 63 (hereinafter referred to as sheet number correction). This stores table data of the graph showing the sheet number dependency shown in FIG. 5. A sheet number correction coefficient c is determined based on the accumulative sheet number, and input in the printing load calculator 51.

A head pressing force Fh for pressing the thermal head 20 against the color thermal recording paper 2 in printing is stored in a printing pressure LUT memory 65. The head pressing force Fh is input in the printing load calculator 51.

A motor controller 67 is connected with the microcomputer 47. The motor controller 67 switches pulse rate for driving the feeding motor 16 based on motor rotation speed input from the LUT memory 52, and controls the feeding speed of the color thermal recording paper 2.

The printing load calculator 51 calculates the printing load of each line by using of equations (1) and (2).

Fp: printing load $\mu_0$: reference coefficient of dynamic friction

Mn: coefficient of dynamic friction of the nth heating element

Fh: head pressing force

Nh: total number of heating elements used for print a: humidity correction coefficient b: paper type correction coefficient c: sheet number correction coefficient $$\mu_n = a \times \mu_0 + b + c$$

$$Fp = \frac{\sum_{n=0}^{Nh} \mu_n}{Nh} \times Fh$$

To record the Mth line, Nh heating elements 23*a* are driven simultaneously, and then at most Nh dots are recorded. Accordingly, the nth heating element records one dot for one image data. The equation (1) shows the coefficient of dynamic friction $\mu_n$ at the time the nth heating element records one dot. The coefficient of dynamic friction $\mu_n$ is calculated by multiplying the reference coefficient of dynamic friction $\mu_n$ by the humidity correction coefficient a, and then adding up the paper type correction coefficient b and the sheet number correction coefficient c. The equation (2) shows the printing load Fp in the one line print. The equation (2) is calculated by multiplying the average value of the coefficient of dynamic friction $\mu_n$ of each heating element by the head pressing force Fh. The rotation speed of the feeding motor 16 at the time of recording of the Mth line is determined by the printing load Fp of the Mth line.

In addition, the printing load of each line may be calculated as follows: the average value of the reference coefficient of dynamic friction $\mu_0$ is calculated; the printing load is calculated by multiplying the average reference coefficient of dynamic friction by the head pressing force Fh; the correction value is calculated by adding the humidity correction coefficient, the paper type correction coefficient, and the sheet number correction coefficient; the corrected printing load is calculated by correcting the printing load with the use of the correction value; and the rotation speed of the feeding motor 16 is controlled according to the corrected printing load when the Mth line is recorded.

Next, the operation of the above embodiment is explained. If a user indicates start of the printing, the recording paper roll 11 is rotated by the rotation of the feeding motor 16, and then the color thermal recording paper 2 is fed in the A direction. During the feeding, the leading edge of the color thermal recording paper 2 is detected by the leading edge detecting sensor 25. When the leading edge has been detected, the rotation of the feeding motor 16 is stopped. While the feeding is stopped, the pinch roller 18 is moved by a shift mechanism (not shown), and the color thermal recording paper 2 is fed to be held between the pinch roller 18 and the capstan roller 17.

When the feeding motor 16 is rotated again, the color thermal recording paper 2 is fed by a predetermined amount by the feeder roller pairs 15. During the rotation of the feeder roller pairs 15, a driving pulse of the feeding motor 16 is counted up or down. A feeding position of the color thermal recording paper 2 is determined according to the counted number of the driving pulse.

Thereafter, the feeding motor 16 is started to rotate in backward direction, to withdraw the color thermal recording paper 2 in the B direction. At the same time, the platen roller 21 is moved by the shift mechanism (not shown), and the color thermal recording paper 2 is sandwiched between the platen roller 21 and the heating element array 23. If a rear end of the recording area (print-starting position) in the color thermal recording paper 2 reaches a position of facing the heating element array 23, the yellow image is started to be printed.

During the rotation of the recording paper roll 11, the data mark pattern 11*b* of the roll core 11*a* is read by the paper type discerning sensor 58, and input in the type correction LUT memory 61 through the A/D converter 54. Additionally, the humidity in the printer is measured by the humidity sensor 56, and input in the humidity correction LUT memory 59 through the A/D converter 53.

The image data to be printed is written in the frame memory 45 beforehand. When printing the yellow image, the yellow image data is read from the frame memory 45 line by line, and stored in the line memory 46 as the line data. The microcomputer 47 reads the line data of the yellow image data from the line memory 46, and inputs the line data in the density-to-heat LUT memory 49. This converts the line data to the heat energy data of each heating element 23*a*.

The heat energy data of each heating element 23*a* is input in the heat-to-friction LUT memory 50. This converts each heat energy data to the reference coefficient of dynamic friction $\mu_0$ The reference coefficient of dynamic friction $\mu_0$ of each heating element 23*a* is input in the printing load calculator 51.

Except for the reference coefficient of dynamic friction $\mu_0$, the humidity correction coefficient a, the paper type correction coefficient b, the sheet number correction coefficient c, and the head pressing force Fh are input in the printing load calculator 51. The printing load calculator 51 calculates the equations (1) and (2) by using of these elements, and thereby the printing load Fp at the time when one line is printed is calculated.

The printing load Fp is input in the LUT memory 52 and converted to the motor rotation speed. The motor controller 67 adjusts the pulse rate of the driving pulse based on the motor rotation speed input from the load-to-speed LUT memory 52. The feeding motor 16 is rotated at the speed responsive to the printing load Fp in the first line of the yellow image. The feeder roller pairs 15 are rotated by the feeding motor 16, to feed the color thermal recording paper 2 in the B direction. At the same time, the first line of the yellow image is printed.

Hereinafter, as well as the case of the first line, the second line and the successive lines are printed while the rotation speed of the feeding motor 16 is controlled so as to regulate the feeding speed of the thermal recording paper 2 in accordance with the printing load of which the image data, the humidity, the contamination of the thermal head, and the paper type are considered. Thereby, it is possible to print the yellow image without the density unevenness, free of causing the dot size in the paper feeding direction to become ununiformity due to the irregular paper feeding speed.

The feeding of the color thermal recording paper 2 in the B direction is stopped when the yellow image has been printed, and then the platen roller 21 is separated from the color thermal recording paper 2. The color thermal recording paper 2 is fed in the A direction by the rotation of the feeding motor 16 after the yellow fixing lamp 35 has been turned on. At that time, the near-ultraviolet rays are applied to the color thermal recording paper 2, so that the yellow thermosensitive coloring layer 6 is fixed.

The yellow fixing lamp 35 is turned off when the yellow thermosensitive coloring layer 6 in the recording area has been fixed. The color thermal recording paper 2 is fed again in the B direction. As aforementioned, the magenta image is printed line by line when the print-starting position of the recording area has been reached the position of facing the heating element array 23.

In the printing of the magenta image, the rotation speed of the feeding motor 16 is controlled so as to keep unchanged the feeding speed of the color thermal recording paper 2 in accordance with the printing load of which the image data, the humidity, the contamination of the thermal head, and the paper type are considered, as well as the case of the yellow image. Accordingly, the color registration error between the yellow image and the magenta image and the density unevenness caused by the ununiformity of the dot size will not occur.

The magenta thermosensitive coloring layer 5 is fixed by the magenta fixing lamp 36 after printing of the magenta image. Thereafter, the cyan image is printed. When printing the cyan image, the color registration error and the density unevenness are not created as well as the case of the yellow image and the magenta image.

The color thermal recording paper 2 in which the cyan image has been printed is fed in the A direction. The end of the recording area is cut by the cutter device 38, and the color thermal recording paper 2 is discharged from the printer as a color print. The sheet counter 57 is counted up after the cyan image has been printed. In the color print, the yellow, magenta, and cyan images are printed without the color registration error.

The one-line printing cyclic process may be changed in response to a change of the printing load instead of changing the rotation speed of the feeding motor 16 according to the variation of the printing load. The one-line printing process is lengthened when the feeding speed of the color thermal recording paper 2 becomes slow down due to the printing load. Meanwhile, the one-line printing process is shortened when the paper feeding speed becomes fast.

FIG. 9 shows the embodiment in which the one-line printing process is changed. The one-line printing process in response to the printing load is stored in a printing period LUT memory 70. The printing load calculated by the printing load calculator 51 is converted to the one-line printing process by the printing period LUT memory 70. A printing controller 72 changes a driving time in the thermal head in response to the one-line printing process. It is possible to perform high-quality printing without the color registration error and the density unevenness in this embodiment as well as the aforementioned embodiment.

According to the foregoing embodiments, the paper type correction means, the humidity correction means, and the sheet number correction means are provided. However, one of these correction means may be provided, for example the paper type correction means. In this case, it will be understood that only the paper type correction coefficient is used.

In the foregoing embodiments, the printing load is corrected in accordance with the humidity, the contamination of the thermal head, and the paper type; however, the temperature in the printer, deterioration of the feeder roller pairs, and so forth may be applied as other factors. If a recording paper with different specifications is sold in future, correction data for the paper type can be additionally written in the table data for the paper type.

Furthermore, although the color thermal printer is explained in the foregoing embodiments, a monochrome thermal printer and wax transfer thermal printer, which is used with an ink ribbon and a normal (PPC) paper, may be applied to the present invention. The present invention may be applied to a three-head one-pass type color thermal printer in which the three thermal heads are disposed in the paper feeding direction, and the three primary color images are recorded in a frame sequential fashion while the recording paper is fed in one direction.

A cut-sheet paper may be used instead of the long recording paper. When the cut-sheet paper is used, a large platen drum is used instead of the feeder roller pairs. The platen drum rotates with holding the recording paper in a periphery surface thereof. In addition, a DC motor may be used as the feeding motor. In this case, the feeding speed is changed by adjusting of the driving voltage.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A color thermal printer for printing at least three primary color images on a recording material in frame sequential fashion, said color thermal printer comprising:

a feeding motor for feeding said recording material;

at least one thermal head for printing one of said three primary color images on said recording material by one line in a one-line printing cyclic process, said thermal head having each heating element for generating heat based on image data by pressing said recording material with predetermined pressing force;

a correction device for setting a correction coefficient, said correction device including at least one of a type dependency correction unit, a humidity dependency correction unit, and a sheet number dependency correction unit, said type correction unit setting a type dependency correction coefficient based on a type of said recording material, said humidity correction unit setting a humidity dependency correction coefficient based on the humidity, and said sheet number correction unit setting a sheet number dependency correction coefficient based on accumulative sheet number, said correction coefficient being based on said type correction coefficient, said humidity correction coefficient, and said sheet number correction coefficient;

a determination device for calculating a printing load per said one line based on said image data, said pressing force of said thermal head, and said correction coefficient; and a motor controller for controlling the rotation speed of said feeding motor according to the printing load per said one line.

2. A color thermal printer as claimed in claim 1, wherein said determination device comprises:

a first converter for converting said image data of said one line to the heat energy for respectively said heating elements;

a second converter for converting the heat energy of respectively said heating elements to coefficients of dynamic friction; and a printing load calculator for calculating said printing load of said one line based on said coefficients of dynamic friction, said correction coefficient, and said pressing force.

3. A color thermal printer as claimed in claim 2, wherein said printing load calculator corrects said coefficients of dynamic friction by using of said correction coefficient, calculates the average value of said corrected coefficients of dynamic friction, and calculates said printing load of said one line by multiplying said average value by said pressing force.

4. A color thermal printer as claimed in claim 2, wherein said feeding motor is a stepping motor, and rotates feeder roller pairs for feeding said recording material by nipping thereof.

5. A color thermal printer as claimed in claim 2, wherein data of said type of said recording material detected by a type discerning sensor is input in said type correction unit, further comprising a humidity sensor for detecting said humidity, wherein data of said detected humidity is input in said humidity correction unit, and data of said accumulative sheet number detected by a sheet counter is input in said sheet number correction unit.

6. A color thermal printer for printing at least three primary color images on a recording material in frame sequential fashion, said color thermal printer comprising:

a feeding motor for feeding said recording material;

at least one thermal head for printing one of said three primary color images on said recording material by one line in a one-line printing cyclic process, said thermal head having each heating element for generating heat based on image data by pressing said recording material with predetermined pressing force;

a correction device for setting a correction coefficient, said correction device including at least one of a type dependency correction unit, a humidity dependency correction unit, and a sheet number dependency correction unit, said type correction unit setting a type dependency correction coefficient based on a type of said recording material, said humidity dependency correction unit setting a humidity dependency correction coefficient based on the humidity, and said sheet number dependency correction unit setting a sheet number dependency correction coefficient based on accumulative sheet number, said correction coefficient being based on said type correction coefficient, said humidity correction coefficient, and said sheet number correction coefficient;

a determination device for calculating a printing load per said one line based on said image data, said pressing force of said thermal head, and said correction coefficient; and a printing controller for changing said one-line printing process according to said printing load of said one line.

7. A color thermal printer as claimed in claim 6, wherein said determination device comprises:

a first converter for converting said image data of said one line to the heat energy for respectively said heating elements;

a second converter for converting the heat energy of respectively said heating elements to coefficients of dynamic friction; and a printing load calculator for calculating said printing load of said one line based on said coefficients of dynamic friction, said correction coefficient, and said pressing force.

8. A color thermal printer as claimed in claim 7, wherein said printing load calculator corrects said coefficients of dynamic friction with said correction coefficient, calculates the average value of said corrected coefficients of dynamic friction, and calculates said printing load of said one line by multiplying the average value by said pressing force.

9. A color thermal printer as claimed in claim 8, wherein data of said type of said recording material detected by a type discerning sensor is input in said type correction unit, further comprising a humidity sensor for detecting said humidity, wherein data of said detected humidity is input in said humidity correction unit, and data of said accumulative sheet number detected by a sheet counter is input in said sheet number correction unit.

* * * * *